United States Patent [19]

Rich

[11] 4,086,459

[45] Apr. 25, 1978

[54] ROD ARRAY VACUUM SWITCH FOR HIGH VOLTAGE OPERATION

[75] Inventor: Joseph A. Rich, Schenectady, N.Y.

[73] Assignee: General Electric Company, Schenectady, N.Y.

[21] Appl. No.: 776,641

[22] Filed: Mar. 11, 1977

[51] Int. Cl.[2] ..... H01H 33/66

[52] U.S. Cl. ..... 200/144 B

[58] Field of Search ..... 200/144 B; 313/198, 313/217, 204

[56] References Cited

U.S. PATENT DOCUMENTS

| | | | |
|---|---|---|---|
| 3,679,474 | 7/1972 | Rich | 313/217 |
| 3,798,484 | 3/1974 | Rich | 313/198 |
| 3,997,748 | 12/1976 | Harris | 200/144 B |

*Primary Examiner*—Robert S. Macon

*Attorney, Agent, or Firm*—Marvin Snyder; Joseph T. Cohen; Jerome C. Squillaro

[57] ABSTRACT

A vacuum switch for high voltage operation includes a fixed gap structure comprised of two rod array assemblies in series cascade within the same vacuum envelope, along with a single break butt contact electrode assembly, wherein the movable contact, upon opening, passes entirely through the conducting midplane and takes up a position of symmetry with respect to the fixed contact and the midplane.

8 Claims, 5 Drawing Figures

ROD ARRAY VACUUM SWITCH FOR HIGH VOLTAGE OPERATION

INTRODUCTION

This invention relates to vacuum arc discharge devices, and more particularly to vacuum switches for high voltage operation having a dielectrically-strengthened fixed gap electrode structure and a single break butt contact electrode assembly.

In general, a vacuum switch is a circuit protection device comprising at least one pair of spaced electrodes disposed in an evacuated envelope. The device is operable during electrical overload conditions first to conduct overload current in an arc across an interelectrode gap between the electrode pair and subsequently to extinguish the arc. Vacuum switches include means for conducting current during normal steady-state conditions without arcing, and are adapted to conduct current of amplitude greatly in excess of the normal level through a conductive plasma across the interelectrode gap during overload conditions. The plasma is typically generated by a plasma trigger or by separation of a pair of contacts when the overload (i.e. fault) current actuates or trips an opening mechanism for the vacuum switch.

In J. A. Rich U.S. Pat. No. 3,798,484, issued Mar. 19, 1974 and assigned to the instant assignee, a vacuum arc discharge device adapted to carry high current at increased voltage levels without formation of anode spots is described and claimed. This device includes a central base plate subdividing the evacuated envelope into adjacent first and second regions. Primary arc-electrode assemblies are disposed in the respective first and second regions and supported by respective, opposed parallel end plates, each of the primary arc-electrode assemblies comprising a spaced circular array of cylindrical rod electrodes having smooth cylindrical arcing surfaces and oriented normal to the plane of the end plates. The electrodes of either primary arc-electrode assembly are substantially coaxially aligned with the electrode members of the other assembly. An intermediate arc-electrode assembly, supported by the central base plate, comprises a spaced circular array of cylindrical rod electrodes having smooth cylindrical arcing surfaces, oriented normal to the central base plate and extending into both the first and second regions in an interdigitated alternating sequence with the primary electrodes disposed in the first and second regions, respectively. The device further includes two pairs of butt contacts, for conducting normal steady-state currents, disposed centrally within the respective circular arrays and serially along a single conductive path. Upon current overload, the butt contacts of both pairs are separated simultaneously so as to generate arcs within each of the first and second regions, which are transferred to the joint circular arrays for conduction and subsequent extinction. Thus arcing occurs in the interelectrode gaps within each of the regions. The intermediate arc-electrode assembly furnishes a current path which, during arcing, connects the rod electrodes in the first region in series with the rod electrodes in the second region. This serves to provide the vacuum arc discharge device with a high level of voltage hold-off capability without need for unduly increasing diameter of the envelope.

The apparatus of the aforementioned Rich U.S. Pat. No. 3,798,484 functions to provide a rapid separation of the electrodes to establish a current-interrupting arc. By employing a movable contact in each pair of separable contacts, the movable contacts being actuated from opposite sides of the discharge device, each movable contact need only move half the distance moved by the movable contact for a single pair of separable contacts in order to achieve the same total separation within the central butt contact circuit path. Because the movable contact inertia must be overcome before the contacts are separated by their maximum distance, a double-break butt contact of the type thus described responds quickly to circuit overloads. However, to obtain these advantages, the device is necessarily more complicated mechanically than one in which a single contact of one pair of contacts is displaceable. For switchgear in which only a single vacuum arc discharge device per pole is necessary, the "double-ended" opening requirement wherein the two opening motions are oppositely directed, may not be burdensome. However, in cases where a plurality of vacuum arc discharge devices must be connected in series, the problem of designing an adequate operating mechanism can become relatively formidable.

The present invention concerns an alternative to the double-ended series double break arrangement of the aforementioned Rich U.S. Pat. No. 3,798,484. The intent is to obtain the dielectric strength inherent in a cascaded. rod array electrode structure, but to combine that structure with a single-break butt contact assembly. To accomplish this result, the arc must be made capable of transferring to both stages of the two-stage fixed gap rod array structure when the single pair of contacts is opened. This necessitates passing the movable contact completely through the electrically-conductive midplane of the vacuum arc discharge device, thus drawing the initial arc upon the parting butt contacts completely through the electrically-floating midplane. In the fully-open contact position, the movable contact takes up a position of symmetry with respect to the fixed contact and the midplane.

Accordingly, one object of the invention is to provide a vacuum arc discharge device having a cascaded two-stage rod array electrode structure wherein a single-break butt contact assembly initiates arcing in both stages of the structure.

Another object of the invention is to provide a vacuum arc discharge device having a rod array electrode structure wherein a movable, electrically-arcing butt contact is passed completely through a conductive, electrically-floating midplane.

Another object is to provide a vacuum arc discharge device having a cascaded two-stage rod array electrode structure wherein a movable butt contact initiates arcing by moving from a position abutting a fixed contact entirely within one portion of the device to a position of symmetry with respect to the fixed contact and the midplane in another portion of the device.

Briefly, in accordance with a preferred embodiment of the invention, a vacuum switch having separate arcing stages in cascade comprises a hermetically sealed, evacuated envelope having first and second base plates at opposite ends of the envelope and a central base plate disposed in the envelope to partition the envelope into first and second regions, each of the base plates being parallel to each other. First and second primary arc-electrode assemblies are disposed in the first and second regions, respectively, and are supported by the first and second respective base plates. Each of the primary arc-electrode assemblies comprises a spaced circular array of cylindrical rod electrodes oriented normal to the plane of the base plates, each rod having a smooth cylindrical arcing surface. The first and second primary arc-electrode assemblies are substantially coaxially aligned with each other. An intermediate arc-electrode assembly, supported by the central base plate, comprises a spaced circular array of cylindrical rod electrodes oriented normal to the plane of the base plates, each rod having a smooth cylindrical arcing surface. The intermediate arc-electrode assembly extends into both the first and second regions in an interdigitated alternating sequence with the primary arc-electrodes disposed in the first and second regions, respectively. First and second butt contacts for conducting normal steady-state current are provided centrally within the respective circular arrays. The first butt contact is situated entirely within the first region and is mechanically and electrically coupled to the first base plate. The second butt contact is electrically coupled to the second base plate and longitudinally movable through a central aperture in the central base plate so as to be entirely within the first region when contacting the first butt contact and retractable entirely into the second region when the first and second butt contacts are parted upon a current overload condition.

BRIEF DESCRIPTION OF THE DRAWINGS

The features of the invention believed to be novel are set forth with particularity in the appended claims. The invention itself, however, both as to organization and method of operation, together with further objects and advantages thereof, may best be understood by reference to the following description taken in conjunction with the accompanying drawings in which:

DESCRIPTION OF TYPICAL EMBODIMENTS

Figure 1:
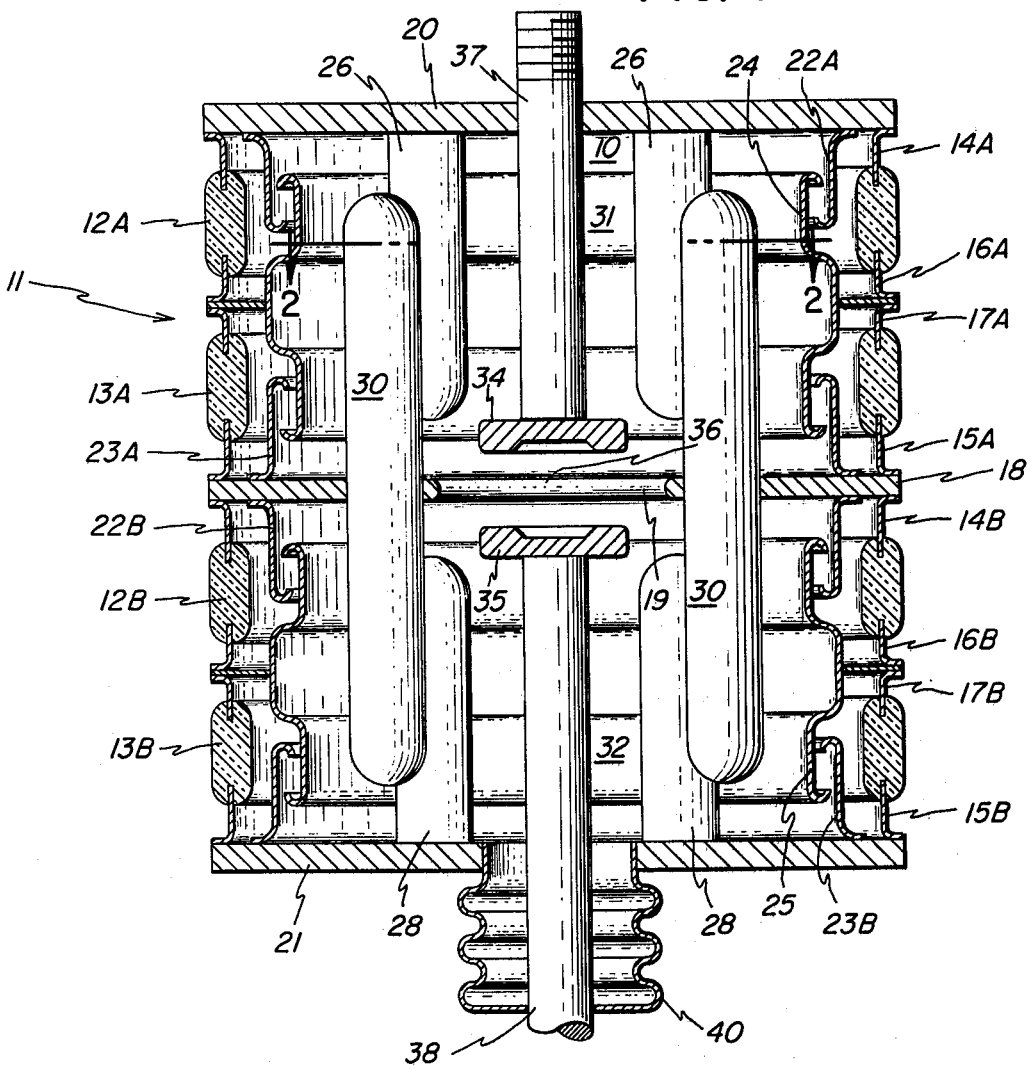
FIG. 1 is a longitudinal, sectional, schematic illustration of a vacuum arc discharge device constructed in accordance with a first embodiment of the invention.

One embodiment of a vacuum switch 10 constructed in accordance with the instant invention is illustrated in FIG. 1. The vacuum switch comprises an envelope 11, the interior of which is evacuated of gas. Envelope 11 comprises insulating side wall members 12A and 13A, such as glass, hermetically sealed to metallic flanges 14A and 15A, respectively, about upper region 31, and further comprises insulating side wall members 12B and 13B, such as glass, hermetically sealed to metallic flanges 14B and 15B, respectively, about lower region 32. Flange 14A is hermetically sealed to a first metallic end wall 20, while flange 15A is hermetically sealed to a central base plate 18. Similarly, flange 14B is hermetically sealed to intermediate base plate 18, while flange 15B is hermetically sealed to a second metallic end wall 21. The opposite ends of insulating side wall members 12A and 13A are hermetically sealed through metallic flanges 16A and 17A, respectively, while the opposite ends of insulating side wall members 12B and 13B are hermetically sealed to metallic flanges 16B and 17B, respectively. Opposed end walls 20 and 21 are parallel to base plate 18.

Flanges 16A and 17A are connected together, and protected by, a shield 24, while flanges 16B and 17B are connected together, and protected by, a shield 25. Shields 24 and 25 are welded or otherwise affixed to flanges 16A and 17A, and to flanges 16B and 17B, respectively. Metallic shields 22A, 23A, 22B and 23B, as well as metallic shields 24 and 25, prevent molten metal particles and/or metal vapor emitted in the arcing region from adhering to, and electrically short-circuiting, insulating side wall members 12A, 13A, 12B and 13B. In addition, shields 22A, 23A, 22B and 23B, serve to relieve voltage stresses at the glass-to-metal seals of flanges 14A, 15A, 14B and 15B, respectively, by grading the electric field thereat. The shields and end walls are typically comprised of stainless steel.

A pair of similar, primary arc-electrode assemblies, comprising circular arrays of rod electrodes 26 and 28, respectively, are similarly disposed, coaxially in longitudinal alignment, respectively, from respective end plates 20 and 21. Each of primary electrodes 26 and 28 has a smooth, cylindrical arcing surface. Primary electrodes 26 and 28 are oriented normal to their respective supporting base plates 20 and 21, and hence are parallel to each other. Additionally, an intermediate arc-electrode assembly, supported by central base plate 18, comprises a spaced, circular array of rod electrodes 30 having smooth, cylindrical arcing surfaces. Intermediate electrodes 30 are oriented normal to central base plate 18 and include portions extending above and below base plate 18 so as to interleave with the arrays of electrodes 26 and 28. Central base plate 18 divides the interior of vacuum switch 10 into upper region 31 and lower region 32 and, in each region, a joint circular array of rod electrodes is thereby formed by arc-electrodes 26, 28 and 30, each joint circular array comprising a plurality of oppositely-extending rod electrodes of alternating polarity.

Figure 2:
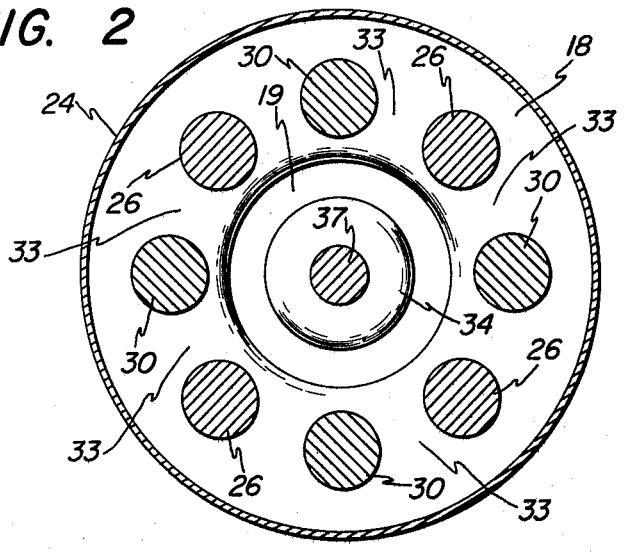
FIG. 2 is a sectional view along line 2—2 in FIG. 1.

In FIG. 2, a horizontal cross-sectional view of section 31 of switch 10 in FIG. 1 illustrates the alternating array of rod electrodes 26 and 30. Each pair of adjacent rod electrodes 26 and 30 defines an interelectrode gap 33 therebetween to which the arc, initially struck by starter electrodes 34 and 35, shown in FIG. 1, is transferred for extinction in order to achieve current interruption. During arcing, a portion of the total arcing current conducted through vacuum switch 10 is carried across each of interelectrode gaps 33.

The joint circular array of rod electrodes 26 and 30 in region 31, and the joint circular array of rod electrodes 28 and 30 in region 32, each constitutes a separate arcing stage. The two stages are in cascade, or series. (Those skilled in the art will recognize that the shield assemblies, as well as the rod arrays, are in cascade, or series.) Together, the joint circular arrays of rod electrodes provide a plurality of parallel, electrically-conductive paths through envelope 11. Each parallel, electrically-conductive path, as defined by a pair of oppositely-extending primary rod electrodes 26 and 28 and an intermediate rod electrode 30 immediately adjacent and forming respective arcing gaps with both sets of primary rod electrodes, thus includes a pair of interelectrode gaps 33 in series relationship, so that the voltage drop through the path formed by the three electrodes 26, 30 and 28 is essentially equal to the sum of the voltage drops across the two gaps 33 therebetween. By thus disposing a pair of similar interelectrode gaps 33 in series in each of the parallel conductive paths, the voltage hold-off capacity of a conventional rod array vacuum switch device is substantially doubled in exchange for a lengthening of the vacuum switch envelope without need for enlarging the envelope diameter. The advantages of employing a pair of joint, circular arrays of rod electrodes in a vacuum switch are described in greater detail in the aforementioned Rich U.S. Pat. No. 3,798,484 and, as stated therein, the electrode members are fabricated of material having sufficiently high vapor pressure to provide a copious quantity of metallic particles during high magnitude current arcing in order to furnish adequate conduction carriers at that time.

Arc-initiating means are provided in the form of starter arc-electrode contacts comprising a pair of mating, separable, massive butt-type contacts 34 and 35 disposed along a single conductive path for carrying normal steady-state current. Contacts 34 and 35 are typically comprised of well-known contact materials such as copper-bismuth, copper-beryllium, beryllium, etc. These butt-type mating contacts, centrally disposed within the respective joint circular rod electrode arrays, are separable to define a starter arcing gap 36. Gap 36 extends from region 31 into region 32 since movable contact 35, when retracted to its maximum distance from fixed contact 34, assumes a position of symmetry with respect to contact 34 and the plane of intermediate base plate 18. Base plate 18 contains a central aperture 19 therein through which contact 35 passes when withdrawn from its closed position located entirely within upper region 31. Therefore, upon current overload, withdrawal of butt contact 35 from contact 34 generates a single electrical arc which, in region 31, transfers to the joint circular array of rod electrodes 30 and 26, and in region 32, transfers to the joint circular array of rod electrodes 30 and 28.

Contact 34 is supported by a fixed conductive rod 37 which is mechanically and electrically affixed to base plate 20. Movable contact 35 is supported by a conductive rod 38 which is reciprocally movable through base plate 21. A bellows 40, hermetically sealed to rod 38 at one end and to base plate 21 at the opposite end, maintains integrity of the hermetic seal of envelope 11 regardless of the position of actuating rod 38. Rod 38 is electrically coupled to end plate 21 as by a conductive braid (not shown).

During operation of device 10 shown in FIGS. 1 and 2, normal steady-state current is conducted centrally through the vacuum switch along the path formed by conductive rods 38 and 37 through mating electrodes 34 and 35 in region 31. Intermediate electrodes 30 and intermediate base plate 18 are electrically floating with respect to electrodes 26 and 28 and their respective base plates 20 and 21 attached thereto, and are electrically floating with respect to contacts 34 and 35 which are electrically connected, respectively, to base plates 20 and 21, respectively.

When a current overload condition occurs, actuating rod 38 retracts butt contact 35 from butt contact 34, withdrawing contact 35 through central aperture 19 in central base plate 18 to a location within region 32 of the vacuum switch, positioning contact 35 at a symmetrical location with respect to contact 34 and the plane of intermediate base plate 18 which corresponds to the midplane of device 10. By withdrawing electrode 35 a sufficient distance from electrode 34, an arc struck in gap 36 becomes sufficiently large such that induced magnetic forces acting upon the arc cause it to spread out almost instantaneously, forcing the arc into the plurality of interelectrode gaps 33 between the alternating polarity, adjacent electrode members in the joint circular array in each of vacuum switch sections 31 and 32. The overload current then flowing through the switch is conducted from either of base plates 20 or 21 directly to the array of primary rod electrodes supported thereby, and then through the array of rod electrodes 30 to the array of primary rod electrodes supported by the opposite base plate, and out of device 10. The plurality of high current arcs formed by the overload current at this time is sustained by a conductive plasma comprising metallic particles emitted from the electrodes in each of the joint circular arrays of rod electrodes. The conductive plasma permits the arcs to be transferred across interelectrode gaps 33 in electrically parallel paths until the arcing current amplitude passes through zero and conduction ceases, giving the metal vapor an opportunity to cool and condense upon the surfaces of the shields and rod electrodes, as well as other accessible surfaces. When the next cycle of alternating voltage is applied across contact gap 36 and interelectrode gaps 33, the high dielectric strength of the vacuum within the device prevents reestablishment of the arcs, so that current flow remains terminated. Normal steady-state conduction is resumed when movable contact 35 is actuated by rod 38 to return to its position within region 31 and again mate with fixed contact 34. Thus upon each interruption, movable contact 35 must pass completely through the midplane of discharge device 10 and, to reestablish normal current flow, must again return through the midplane. Since the device is mechanically actuable entirely from one end, the actuating mechanism (not shown) for the device is considerably simpler than that for devices which are actuable from both ends simultaneously.

Figure 3:
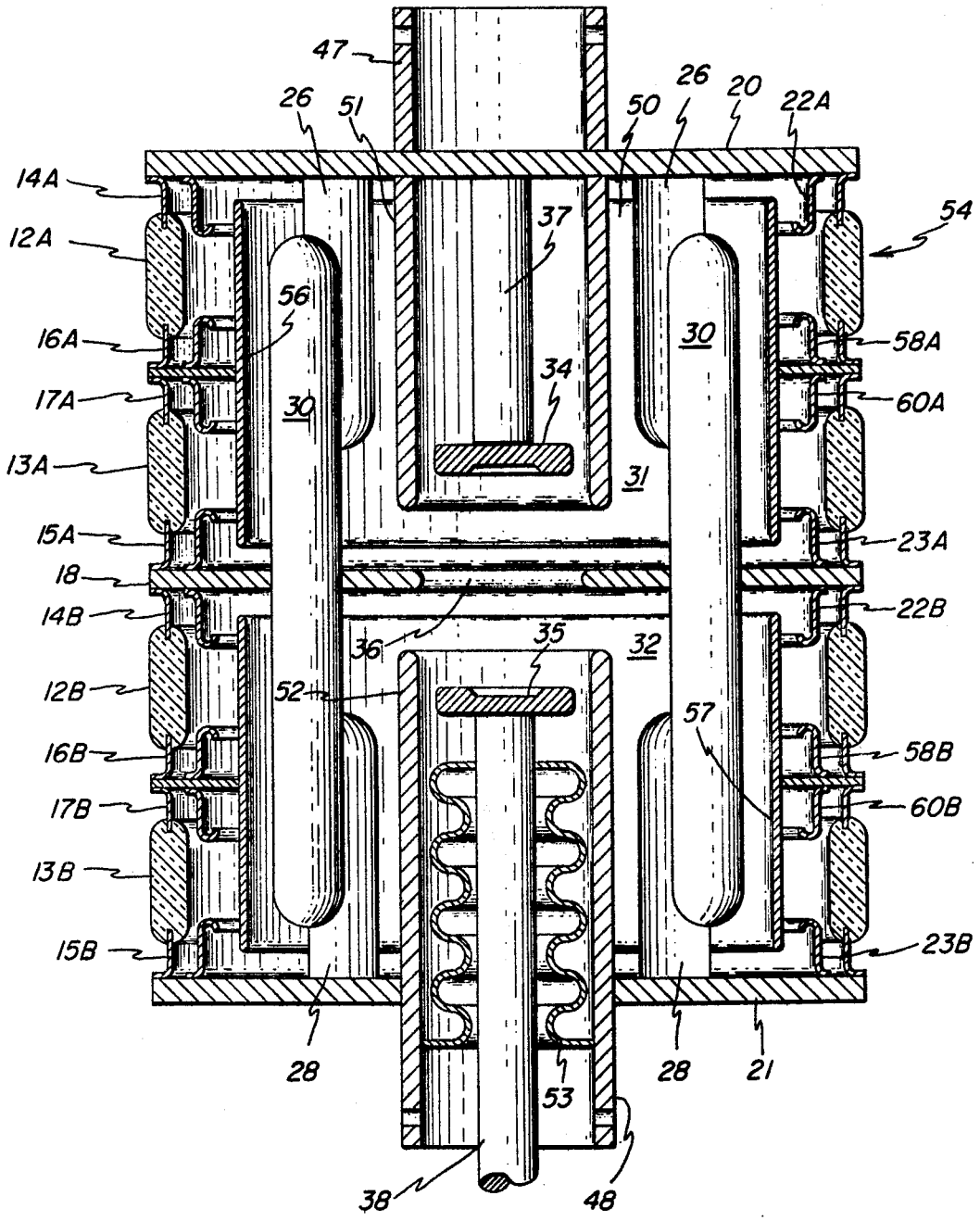
FIG. 3 is a longitudinal, sectional, schematic illustration of a vacuum arc discharge device constructed in accordance with a second embodiment of the invention wherein shields are provided for butt contacts.

FIG. 3 illustrates a second embodiment of the invention wherein a vacuum switch 50 having rod electrode arrays 26, 28 and 30 of the type shown in FIG. 1, along with a single pair of butt contacts 34 and 35, employs a first metal cylinder or sleeve 51 surrounding contact 34 and its fixed supporting rod 37, and a second metal cylinder or sleeve 52 surrounding contact 35 when its reciprocally-movable actuating rod 38 has retracted the contact to its position of symmetry with respect to contact 34 and the plane of intermediate base plate 18. Shield 51 is electrically and mechanically connected to base plate 20, and makes a hermetic seal therewith, while shield 52 is electrically and mechanically connected to base plate 21 and makes a hermetic seal thereto. A bellows 53 is hermetically sealed, at one end, to the interior of shield 52 and, at the opposite end, to actuating rod 38. Rod 38 typically is electrically connected to base plate 21 through an electrically conductive braid (not shown).

The sidewall and shield structure of the device shown in FIG. 3 is but slightly different from that of the device shown in FIG. 1. That is, envelope 54 comprises insulating side wall members 12A and 13A, such as glass, hermetically sealed to metallic flanges 14A and 15A, respectively, about upper region 31, and further comprises insulating side wall members 12B and 13B, such as glass, hermetically sealed to metallic flanges 14B and 15B, respectively, about lower region 32. Flange 14A is hermetically sealed to end plate 20, while flange 15A is hermetically sealed to intermediate base plate 18. Similarly, flange 14B is hermetically sealed to intermediate base plate 18, while flange 15B is hermetically sealed to base plate 21. The opposite ends of insulating side wall members 12A and 13A are hermetically sealed through metallic flanges 16A and 17A, while the opposite ends of insulating side wall members 12B and 13B are hermetically sealed to metallic flanges 16B and 17B, respectively. Flanges 16A and 17A are connected together, and protected by, a pair of shields 58A and 60A, while flanges 16B and 17B are connected together, and protected by, pair of shields 58B and 60B. Shields 58A and 60A, in turn, are protected by an inner shield 56, while shields 58B and 60B are protected by an inner shield 57. Shield members 56, 58A and 60A are welded or otherwise affixed to metallic flanges 16A and 17A, while shields 57, 58B and 60B are welded or otherwise affixed to metallic flanges 16B and 17B. Metallic shield members 22A, 23A, 22B and 23B, as well as metallic shield members 58A, 60A, 58B, 60B, 56 and 57, prevent molten metal particles and/or metal vapor emitted in the arcing region from adhering to, and electrically short-circuiting, insulating side wall members 12A, 13B, 12B and 13B. In addition, shield members 22A, 23A, 22B and 23B, serve to relieve voltage stresses at the glass-to-metal seals of flanges 14A, 15A, 14B and 15B, respectively, by grading the electric field thereat. The shields and end walls, as in the embodiment of FIG. 1, may typically be comprised of stainless steel.

The apparatus of of FIG. 3 provides appreciable dielectric strengthening of the butt contact electrode assembly, this assembly being one of several internal dielectric systems operating in parallel when voltage is impressed across the end plates of the tube. In the fully open gap position of contacts 34 and 35, each of the contacts is located within regions of high dielectric strength metal cylinders or sleeves 51 and 52, respectively, which are relatively field free. The cylinders are of substantially identical configuration and are in longitudinal alignment within vacuum switch 50.

As pointed out in J. A. Rich U.S. patent application Ser. No. 678,294, filed Apr. 19, 1976 and assigned to the instant assignee, when a voltage is to be interrupted by a vacuum switch, it is necessary to separate the butt contacts of the vacuum switch by a sufficient distance to prevent the arc from reestablishing itself directly between each of the butt contacts after arc extinction. This distance necessarily becomes larger as interruption voltages become higher, making the time necessary to achieve sufficient separation critical to proper operation of the device at these higher interruption voltages. By providing cylindrical shields which maintain the butt contacts in a relatively field-free region upon opening thereof, the distance that must be traveled by the retractable contact upon opening is actually increased, due to the need for the abutting surfaces of contacts 34 and 35 to be encircled by shield 51. This need arises since metal splatter from the contacts, which occurs when movable contact 34 is in the initial phase of its opening travel, is intercepted by shield 51 and thereby kept off the rod electrodes so as not to affect their arcing performance detrimentally. The arc transfers immediately from the butt contacts to rod electrodes 26, 28 and 30 in the manner described in conjunction with the embodiment of FIG. 1, under the influence of magnetic forces which instantaneously tend to hurl the electric arc outwardly toward the rod electrode arrays. Shields 51 and 52 may comprise copper, Vascomax marging alloy (available from VASCO, Latrobe, Pennsylvania) or any gas-free cold cathode electrode material, and may further serve as discharge device terminals 47 and 48, respectively.

Figure 4:
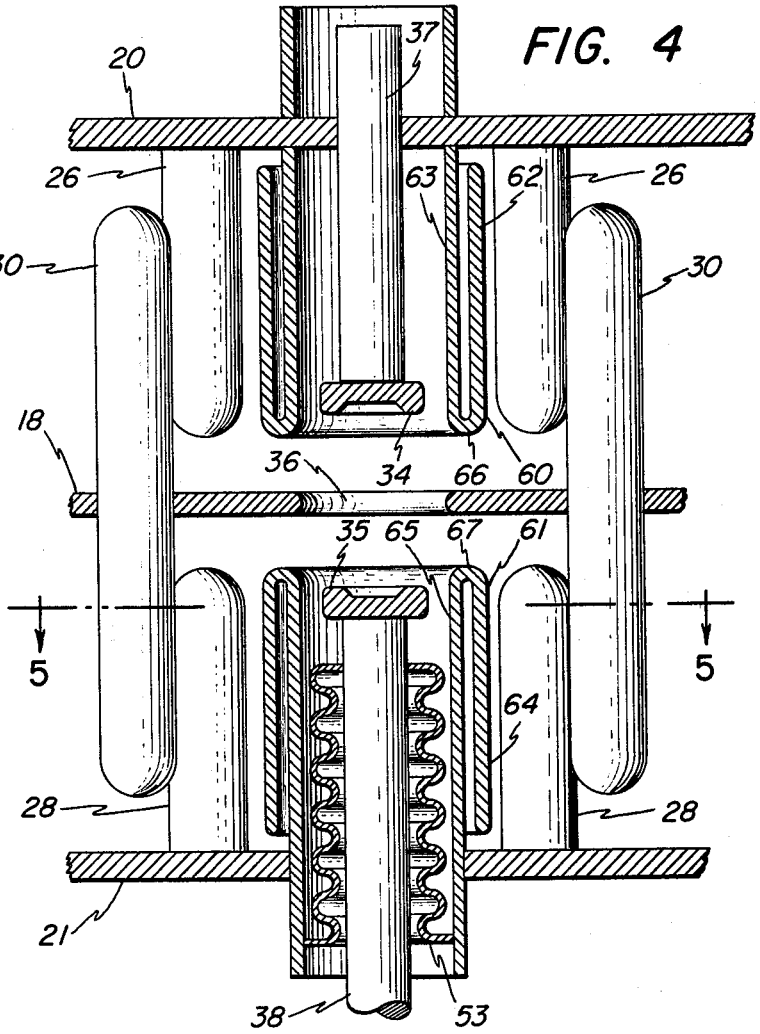
FIG. 4 is a longitudinal, sectional, schematic illustration of the electrodes of a vacuum arc discharge device constructed in accordance with another preferred embodiment of the invention wherein a coaxial shield structure is provided for the butt contacts.

FIG. 4 illustrates a modification of a vacuum switch embodiment shown in FIG. 3. In the embodiment of FIG. 4, butt contact 34 is situated within a first high dielectric strength shield 60 while butt contact 35 is retractable into a second high dielectric strength shield 61. Each of shields 60 and 61 is of substantially identical configuration and constructed of a pair of coaxial walls 62 and 63, and 64 and 65, respectively, each pair of coaxial walls being connected at its innermost end through a lip structure 66 and 67, respectively. As with shields 51 and 52 in the embodiment of FIG. 3, shields 60 and 61 are in longitudinal alignment within the vacuum switch and may comprise copper, Vascomax maraging alloy, or any gas-free cold cathode electrode material. In this embodiment, not only are the separable butt contacts located within relatively field-free regions or cavities in the cylindrical conductors or sleeves, but the cylindrical conductors themselves are shaped so that the outer conducting surfaces constitute part of the overall arc-electrode system. By folding the current path back on itself within shields 60 and 61, the cylindrical conductors may serve as fixed gap diffuse arc electrode structures so that if arcing occurs on these shields, minimal damage will be done to the butt contacts.

Figure 5:
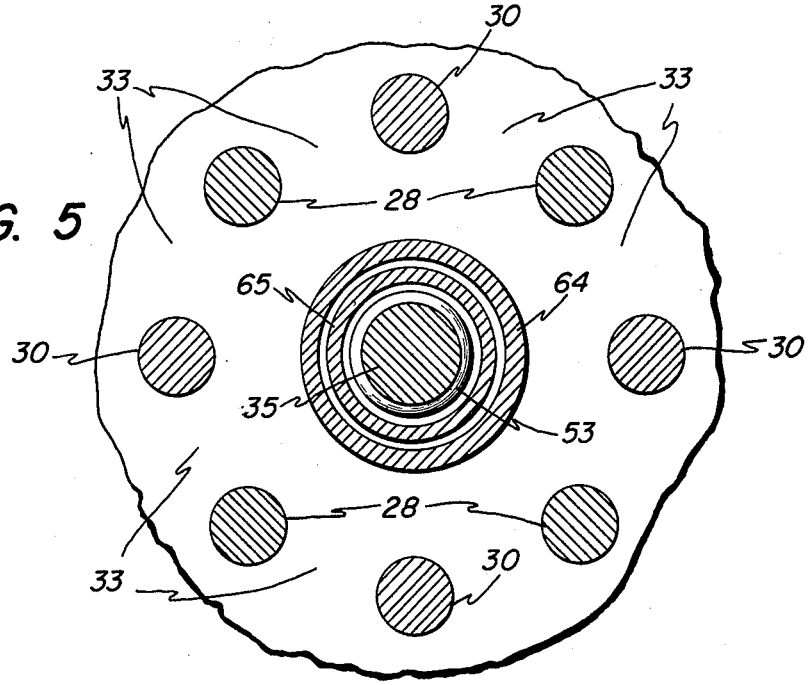
FIG. 5 is a sectional view along line 5-5 of FIG. 4.

FIG. 5, which is a sectional view taken along line 4—4 in FIG. 4, illustrates the relative spacing between the cylindrical rod electrodes and outer cylindrical conducting surface 64 of shield 61, relative to spacing 33 between adjacent rod electrodes. By separating the outer cylindrical conducting surfaces of shields 60 and 61 from the ring of rod electrodes by a distance comparable to interelectrode spacing 33, the cylindrical conducting surfaces become a part of the overall diffuse arc-electrode structure with a consequent increase in utilizable electrode surface area per unit volume. Apart from these features, the embodiment of FIG. 4 operates in a fashion essentially identical to that of the embodiment of FIG. 3.

The foregoing describes a vacuum arc discharge device having a cascaded two-stage rod array electrode structure wherein a single-break butt contact assembly initiates arcing in both stages of the structure. Upon initiation of circuit interruption, a movable, electrically-arcing butt contact passes through a conductive, electrically-floating midplane. The movable butt contact initiates arcing by moving from a position abutting a fixed contact entirely within one portion of the device, to a position of symmetry with respect to the fixed contact and the midplane in another portion of the device.

While only certain preferred features of the invention have been shown by way of illustration, many modifications and changes will occur to those skilled in the art. It is, therefore, to be understood that the appended claims are intended to cover all such modifications and changes as fall within the true spirit of the invention.

I claim:

1. A vacuum switch having two separate arcing stages in cascade, comprising:

a hermetically sealed, evacuated envelope having first and second base plates at opposite ends of said envelope and a central base plate disposed in said envelope to partition said envelope into first and second regions, each of said base plates being parallel to each other;

first and second primary arc-electrode assemblies supported by said first and second respective base plates, disposed in said first and second regions, respectively, each of said primary arc-electrode assemblies comprising a spaced circular array of rod electrodes oriented normal to the plane of said base plates and having smooth arcing surfaces, said first and second primary arc electrode assemblies being substantially aligned longitudinally with each other;

an intermediate arc-electrode assembly supported by said central base plate and comprising a spaced circular array of rod electrodes oriented normal to said central base plate and having smooth arcing surfaces, the electrodes of said intermediate arc-electrode assembly extending into said first and second regions in an interdigitated alternating sequence with said primary electrodes disposed in said first and second regions in an interdigitated alternating sequence with said primary electrodes disposed in said first and second regions, respectively; and first and second butt contacts for conducting normal steady-state current situated centrally within the respective circular arrays of rod electrodes, said first butt contact being situated entirely within said first region and mechanically and electrically coupled to said first base plate, said second butt contact being electrically coupled to said second base plate and longitudinally movable through a central aperture in said central base plate so as to be entirely within said first region when contacting said first butt contact and retractable entirely into said second region when said first and second butt contacts are parted upon occurrence of a current overload condition.

2. The apparatus of claim 1 wherein said second butt contact, when fully retracted from said first butt contact, is situated symmetrically with respect to said first butt contact and said third base plate.

3. The apparatus of claim 1 including a first cylindrical electrical shield, said first butt contact being situated within said first cylindrical electrical shield and said second butt contact being situated within said first shield when abutting said first butt contact, and a second cylindrical electrical shield, said second butt contact being situated within said second electrical shield when fully retracted from said first butt contact.

4. The apparatus of claim 2 including a first cylindrical electrical shield, said first butt contact being situated within said first cylindrical electrical shield and said second butt contact being situated within said first shield when abutting said first butt contact, and a second cylindrical electrical shield, and second butt contact being situated within said second electrical shield when fully retracted from said first butt contact.

5. The apparatus of claim 3 wherein each of said first and second electrical shields comprises an inner cylindrical member, an outer cylindrical member, and a lip member joining said inner and outer cylindrical members at the innermost end of each of said shields.

6. The apparatus of claim 4 wherein each of said first and second electrical shields comprises an inner cylindrical member, an outer cylindrical member, and a lip member joining said inner and outer cylindrical members at the innermost end of each of said shields.

7. The apparatus of claim 5 wherein spacing between a rod electrode of either of said first and second primary arc-electrode assemblies and adjacent rod electrode of said intermediate arc-electrode assembly is substantially equal to spacing between said outer cylindrical member and each rod electrode of said first and second primary arc-electrode assemblies and of said intermediate arc-electrode assembly.

8. The apparatus of claim 6 wherein spacing between a rod electrode of either of said first and second primary arc-electrode assemblies and an adjacent rod electrode of said intermediate arc-electrode assembly is substantially equal to spacing between said outer cylindrical member and each rod electrode of said first and second primary arc-electrode assemblies and of said intermediate arc-electrode assembly.

* * * * *